United States Patent [19]

Smit et al.

[11] Patent Number: 4,582,512

[45] Date of Patent: Apr. 15, 1986

[54] CHEMICAL LEACHING OF COAL TO REMOVE ASH, ALKALI AND VANADIUM

[75] Inventors: Francis J. Smit, Arvada; Dale K. Huggins; Mark Berggren, both of Golden; Kurt R. Anast, Arvada, all of Colo.

[73] Assignee: AMAX Inc., Greenwich, Conn.

[21] Appl. No.: 622,604

[22] Filed: Jun. 20, 1984

[51] Int. Cl.[4] ..... C10L 1/32

[52] U.S. Cl. ..... 44/51; 44/1 R; 44/15 R

[58] Field of Search ..... 44/15 R, 1 R, 51; 201/17

[56] References Cited

U.S. PATENT DOCUMENTS

| | | | |
|---|---|---|---|
| 200,663 | 2/1878 | Morey | 44/15 R |
| 2,162,221 | 6/1939 | Kasehagen et al. | 44/15 R |
| 2,739,105 | 3/1956 | Ford et al. | 201/17 |
| 2,878,163 | 3/1959 | Hutchings | 201/17 |
| 3,214,346 | 10/1965 | Mason et al. | 201/17 |
| 3,393,978 | 7/1968 | Murphy et al. | 201/17 |
| 3,993,455 | 11/1976 | Reggel et al. | 44/15 R |

*Primary Examiner*—William R. Dixon, Jr.
*Assistant Examiner*—Margaret B. Medley
*Attorney, Agent, or Firm*—Michael A. Ciomek; Eugene J. Kalil

[57] ABSTRACT

Powdered coal is upgraded in utility and heat value by removal of ash and pyrite constituents by successively pressure caustic leaching the coal slurry at a temperature of at least about 175° C., hydrochloric acid leaching the caustic leached coal to dissolve ash and pyrite residues not dissolved by the caustic, and pressure leaching the acid leached coal to remove alkali metals and chloride. Vanadium is also removed by the process.

5 Claims, No Drawings

CHEMICAL LEACHING OF COAL TO REMOVE ASH, ALKALI AND VANADIUM

The present invention is directed to the upgrading of crushed or ground coal to remove undesirable inorganic constituents and render the coal suitable for use as a fuel for internal combustion engines, including gas turbines.

BACKGROUND OF THE INVENTION AND THE PRIOR ART

The term "coal" has been used to describe generically a wide variety of naturally-occurring materials which are, in fact, sedimentary rocks of high, but variable, organic content also containing inorganic mineral constituents in varying amounts. The inorganic mineral content of coal can vary widely in composition. In addition, the extent of "coalification" which has occurred in different coals varies significantly and has led to the useful practice of referring to coals by "rank". In accordance with this practice Class I coals are the anthracites; Class II coals are the bituminous; Class III coals are the sub-bituminous and Class IV coals are the lignites. Generally, the lower-ranking coals will have more ash and moisture and lower heat value that the higher ranking coals.

As shown in the book *Low Rank Coal Technology* by Gronhovd, et al, Noyes Data Corporation, 1982, the ash compositions of different-ranking coals are different. Thus, the following table occurs at page 3 of the aforementioned book:

Average Ash Compositions From U.S. Coals of Different Ranks (Weight Percent of $SO_3$ - Free Ash)

| | | Lignite | Subbituminous | Bituminous |
|---|---|---|---|---|
| Acidic Components | $SiO_2$ | 24.9 | 39.4 | 48.1 |
| | $Al_2O_3$ | 14.1 | 21.1 | 24.9 |
| | $Fe_2O_3$ | 11.5 | 10.1 | 14.9 |
| | $TiO_2$ | 0.5 | 0.8 | 1.1 |
| | $P_2O_5$ | 0.4 | 0.4 | — |
| Alkali Components | CaO | 31.2 | 20.1 | 6.6 |
| | MgO | 8.7 | 5.6 | 1.7 |
| | $Na_2O$ | 8.2 | 2.1 | 1.2 |
| | $K_2O$ | 0.5 | 0.3 | 1.5 |

The inorganic or ash constituents of coals are finely disseminated through the organic or carbonaceous constituents so that commonly-used mineral beneficiation techniques are of only limited value in affecting separation. Thus, jigging, dense media separation, cycloning or froth flotation have been used with indifferent results. The ash constituents thus accompany the organic constituents of coal when the coal is crushed or ground and burned, as for example, in a power plant boiler. No heat value is contributed by the ash and combustion gases become laden with the incombustible inorganic material. The ash constituents of some coals are of such composition that they form molten slags which deposit upon boiler tubes and other parts of the combustion apparatus. Such slag deposits interfere with heat transfer across boiler tube surfaces and in some cases are found to corrode boiler tubes and other parts of the combustion apparatus leading to premature failure thereof. Solid ash or slag particles are also destructive and erode boiler tubes and other parts of boilers and other apparatus used for burning coal whether such parts are of metal or refractory. Disposal of the unburned ash is also a problem, whether the ash remains on furnace grates, is captured as fly ash, or otherwise. The melting points of ash from various coals varies widely and in the case of some coals is so low that the ash is removed from the combustion apparatus as a molten slag.

Coal is cheap and plentiful. Many coals approach petroleum oils in terms of heat value per unit weight upon combustion. Direct use of powdered coal as a water slurry or otherwise in heat engines such as gas turbines or diesel engines has been postulated but the destructive effects of the ash constituent of coals due to erosion or corrosion of metal parts within the engines has created a climate of despair on the question of whether such direct use would ever be practical.

It has also been postulated that dispersion of pulverized coal in petroleum-derived fuel oil would provide a substantial increase in heat value of the mixture per unit volume as compared to fuel oil, thereby permitting increased range of steam-powered ships as well as other advantages. However, this potential has not been realized on an extensive scale due to the ash content of coal.

It has been suggested in U.S. Pat. No. 3,993,455 that caustic leaching followed by acid washing be used to reduce the ash content of coal to acceptable levels. However, it is very difficult to remove residual caustic from caustic-treated coal and sodium potassium in coal is itself harmful to mechanical elements of coal combustion equipment.

Despite the problems which have arisen in attempting to employ coal slurry as fuel for gas turbines and the like, economic factors promoting such use are powerful and it has been postulated that, in view of what is known from fuel oil experiences about the harmful effects of ash, alkali metals and vanadium upon gas turbines, the maximum permissible amounts in coal-slurry gas turbine fuel will be 0.85% ash, by weight, 150 ppm alkali metals (Na,K) and 4 ppm vanadium.

A difficult technical problem thus remains in the treatment of coal to provide such low contents of undesired material therein.

BRIEF SUMMARY OF THE INVENTION

Powdered coal is treated to remove inorganic materials, principally ash, therefrom by a process in which essential steps include: pressure leaching the coal with aqueous caustic solution, i.e. sodium hydroxide or potassium hydroxide solution; and acidifying the leach residue with hydrochloric acid and pressure washing the acid treated coal to remove alkali metals, chlorine and other soluble constituents. Vanadium present in the coal is also removed. The resulting fuel may be combusted as a water slurry or otherwise in steam plants, gas turbines, diesel engines, magnetohydrodynamic generators, etc. The product is also a superior starting material for gasification, liquifaction, hydrodesulfurization, etc.

DETAILED DESCRIPTION OF THE INVENTION

It is advantageous to subject the coal to be treated in accordance with the invention to physical beneficiation to remove as much refuse as possible. The coal is thus cleaned initially by means such as jigging, dense media separation, cycloning, froth flotation, etc.

The various leaching steps employed in accordance with the invention involve contact between coal solids and leaching liquids which successively are caustic solution, acid solution, pressure water wash or ammonia solution with various other intermediate or final water washing steps. The coal is ground to the particle size range suitable for the particular coal involved, e.g., a size in the range of about 28 mesh to about 200 mesh. A particle size range of about minus 60 mesh (0.250 mm) to about minus 80 mesh (0.180 mm) appears to be acceptable for bituminous coals. If coal particle size is too coarse, leach results are poor (i.e., insufficient ash is dissolved). If coal particle size is too fine, the slurry becomes too difficult to filter and wash. Those skilled in the art can readily ascertain the most efficient particle size to use when working with a particular coal.

The solids concentration of the slurry is also important. If too high, agitation is difficult, and, if too low, leaching is inefficient. A slurry solids concentration of about 10% to about 30% by weight, was found to be satisfactory with bituminous coals.

The temperature for the caustic leach and for the pressure wash step should be at least about 175° C. up to about 350° C. Even higher temperatures may be used, but satisfactory results have been obtained while operating in the range 200° to 250° C. Reaction times become impractically long at temperatures below about 175° C. The operating pressure is essentially the steam pressure corresponding to the operating temperature. Caustic leach solutions may contain about 50 to about 480 grams per liter (gpl) NaOH and hydrochloric acid leach solutions may contain about 10 to about 220 gpl HCl.

The various steps will be discussed under the appropriate headings, as follows:

1. Sodium Hydroxide Leach

The first major process step is to leach the coal in sodium hydroxide solution at high temperature, in the absence of air or other oxidants. The objective of this leach is to dissolve as much ash as possible and to attack the remainder of the ash, making it acid-soluble. This leach primarily dissolves silica and silicates, but pyrite is also attacked and more or less of the sulfur in the pyrite should dissolve in the leach liquor, depending upon reaction conditions. The iron in the pyrite does not dissolve.

The sodium hydroxide concentration must be high enough to adequately dissolve or attack the ash constituents, but if it is too high, the solubility of the silicates and other ash constituents will be lowered. Leaches were performed with 5 or 10 to 30 weight percent sodium hydroxide solutions, but 25 percent concentrations were used most frequently with bituminous coals and seemed to give the most reliable results.

The leach time necessary is a function of such factors as sodium hydroxide concentration, leach temperature, and particle size and extent of liberation of the ash constituents. For the leaches performed at 230° C. with minus 80 mesh coal, 30 percent slurry solids, and 25 percent sodium hydroxide solution, a 2-hour leach time was usually adequate. All of the leaches were performed on a batch basis. It is felt that shorter leach times would produce adequate results in a continuous process.

The maximum rate of agitation required is that necessary to keep the solids completely suspended. Frequently, rate of leaching or dissolution of a solid will increase as agitation increases, provided the initial rate is relatively low. However, after a certain agitation rate is reached, increased agitation will no longer increase the rate of leaching or dissolution. Too high an agitation rate could alter the physical characteristics of the slurry and result in a slurry which is very difficult to filter and wash. In most of the leaching tests conducted in the two-liter autoclaves (4 in. i.d.), agitation was performed using two 6-bladed pitched-blade turbine impellers of 2 in. diameter, rotating at 600 rpm.

2. Hydrochloric Acid Leach

The second major process step is to leach the coal, after it has been leached with sodium hydroxide and washed, with hydrochloric acid. The objective is to dissolve the remainder of the ash which was not dissolved by the sodium hydroxide leach. This will include iron-containing species, such as those resulting from attack of pyrite by sodium hydroxide, and silicates not dissolved by the sodium hydroxide, such as calcium or magnesium silicates or sodium aluminum silicates.

The same variables which affect the caustic leaching results will affect the acid leaching results. These are: particle size, slurry solids concentration, hydrochloric acid concentration, leach time, leach temperature, and rate of agitation. However, the most important factor in determining the success of the acid leach is the adequacy of the sodium hydroxide leach. If the sodium hydroxide leach is inadequate, the hydrochloric acid leach will also be inadequate.

Most of the leaches were performed at atmospheric pressure, 30 percent solids, 10 percent HCl, 80° C. for 2 hours.

3. High Temperature Water or Ammonia Leach

The third major process step is to leach the coal, after it has been leached with acid and washed, with water or weak, aqueous ammonia in an autoclave at elevated temperature. The objective is to reduce the residual sodium and chlorine content of the coal to as low a level as possible. Experience indicates that small but significant amounts of sodium and chlorine are absorbed in the fine pore structure of the coal and cannot be removed at atmospheric pressure, regardless of how thoroughly the coal is washed. Leaching with hot water or aqueous ammonia at elevated temperature and under pressure is effective in reducing the sodium and chlorine to levels which are significantly lower than can be obtained by washing or leaching with water or aqueous ammonia at atmospheric pressure.

The leaches were performed for 1 hour at 230° C. The laboratory leach was performed at 17 percent solids, and the pilot plant leaches at 30 percent solids.

4. Filtration and Washing

In order to achieve the low levels of sodium and chlorine desired in the final product, filtration and washing must be performed thoroughly and efficiently, especially following the hydrochloric acid and elevated temperature water or ammonia leaches. The filter cake obtained by vacuum filtration of the coal is dense and difficult to wash on the filter. Therefore, in order to thoroughly wash the leached coal, the filter cakes must be repulped and refiltered.

Thorough washing of the coal following the caustic leach is not as important as in the two other major process steps. This is because the coal will be leached with hydrochloric acid in the next step and will have to be washed thoroughly again anyway, in order to remove the chlorine. Furthermore, the more often the coal is washed with water following the sodium hydroxide leach, the more difficult it becomes to filter. In order to avoid filtration difficulties, the coal is washed on the vacuum filter with only one displacement wash of water. It is then repulped in 10 percent hydrochloric acid solution in order to completely acidify the cake, since, after acidification, the coal is once again more easily filtered. One of the main effects of not thoroughly washing the coal before acidification is that the consumption of hydrochloric acid is greater.

Examples will now be given:

The first two examples are for tests which were conducted for removal of ash only. Reducing residual sodium and chlorine levels by the high temperature water or ammonia leach was not attempted. The tests were conducted as follows:

| | |
|---|---|
| Sodium Hydroxide Leach: | 2 hours at 230° C., 30 percent solids, 25 percent NaOH solution, coal minus 80 mesh. |
| Filtration and Washing: | 1 displacement wash on filter with water, filter cake slurred in 10 percent HCl, then filtered. |
| Hydrochloric Acid Leach: | 2 hours at 80° C., 30 percent solids, 10 percent HCl solution. |
| Filtration and Washing: | 1 displacement wash on filter with water, reslurried in water, filtered, reslurried second time in water and filtered. |

Results of leaching two different coals in this manner were as follows:

| Test | Coal Sample | Ash | |
|---|---|---|---|
| | | Before Leaching | After Leaching |
| A | Kentucky 4A Seam HMS* Float | 3.15% | 0.36% |
| B | Sewell Seam 1.3 Sp. Gr. Float | 2.05% | 0.49% |

*HMS: Heavy Media Separation

*HMS: Heavy Media Separation

Note that the results were better for Kentucky 4A coal, even though it initially contained more ash than the Sewell coal.

In order to illustrate the effect of the high temperature leach with water or weak aqueous ammonia, e.g., containing about 5 to about 150 gpl $NH_3$, the final product from Test A was releached in an autoclave at the following conditions:

| | |
|---|---|
| Water Leach: | 1 hour at 230° C., 17 percent solids. Filter cake washed on filter, but not reslurried. |
| Ammonia Leach: | 1 hour at 230° C., 17 percent solids with 5 percent $NH_3$ solution. Filter cake washed on filter, but not reslurried. |

Results were as follows:

| Sample | Na (ppm) | K (ppm) | Cl (%) | V (ppm) |
|---|---|---|---|---|
| Starting Coal | 330 | 160 | 0.12 | 15 |
| After Caustic and Acid Leaching | 540 | 11 | 1.78 | 0.8 |
| $H_2O$, 1 hour at 230° C. | 130 | 14 | 0.28 | 0.8 |
| 5% $NH_3$, 1 hour at 230° C. | 60 | 10 | 0.060 | 0.8 |

The aqueous ammonia was more effective in removing both Na and Cl, than was water alone. However, the pressure developed when using ammonia (530 psig) was much higher than when using water alone (380 psig). The ammonia-leached coal was not analyzed for nitrogen, but it would probably contain more than the coal leached with water only.

In order to show the inadequate results achieved in atmospheric pressure washing after the hydrochloric acid leach, coal treated as in Test A was washed with water and with aqueous ammonia under the following conditions:

| | |
|---|---|
| Water Leach: | 1 hour at 80° C., 30% solids. Filter cake washed on filter, reslurried, filtered and washed on filter. |
| Ammonia Leach: | 1 hour at 80° C., 30% solids. 6% $NH_3$ in water. Filter cake washed on filter, reslurried, filtered and washed on filter. |

Results were as follows:

| Sample | Na (ppm) | K (ppm) | Cl (%) |
|---|---|---|---|
| $H_2O$, 1 hour at 80° C. | 542 | 3 | 2.2 |
| % $NH_3$, 1 hour at 80° C. | 525 | 3 | 0.18 |

The results set forth in the foregoing table demonstrates that washing the acid-leached coal at atmospheric pressure is unsatisfactory. Not only are inordinately long times required, but the contents of alkali metals and chloride remain unacceptably high. Furthermore, large quantities of wash water are required, raising the potential of disposal problems. In strong contrast, pressure leaching with water or ammonia wash solution is quick and effective.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for upgrading powdered coal to improve the usefulness thereof as a fuel for internal combustion engines which comprises;

(a) pressure-leaching powdered coal having a particle size ranging from about 28 mesh to about 200 mesh in an aqueous caustic solution at a temperature ranging from about 175° C. to about 350° C.,
the amount of caustic in said solution ranging from about 5% to about 30% by weight,
the amount of coal being sufficient to form a slurry comprising about 10% to 30% by weight of solids, (b) hydrochloric acid leaching the caustic leached coal to dissolve acid-soluble constituents resulting from said caustic leach, (c) pressure leaching said acid-leached coal with a liquid from the group consisting of water and dilute aqueous ammonia to remove sodium and chlorine, and thereafter (d) filtering and washing said pressure leached coal, whereby said coal is characterized by up to about 0.85% by weight of ash, up to about 150 ppm of alkali metals (Na,K) and up to about 4 ppm vanadium.

2. The process in accordance with claim 1, wherein said pressure leaching temperature is about 230° C.

3. The process in accordance with claim 1, wherein said leaching steps are performed with agitation sufficient to maintain said coal articles in suspension.

4. The process in accordance with claim 1, wherein steps (a) and (b) are conducted for a time sufficient to dissolve substantially all of the ash constituents of said coal.

5. The process in accordance with claim 1, wherein step (c) is conducted for a time sufficient to remove substantially all of the alkali metals and chlorine.

* * * * *